US008547405B2

(12) United States Patent
Weng

(10) Patent No.: US 8,547,405 B2
(45) Date of Patent: Oct. 1, 2013

(54) GAMMA VOLTAGE GENERATION CIRCUIT

(75) Inventor: Meng-Tse Weng, Tainan County (TW)

(73) Assignee: Himax Technologies Limited, Tainan (TW)

( * ) Notice: Subject to any disclaimer, the term of this patent is extended or adjusted under 35 U.S.C. 154(b) by 895 days.

(21) Appl. No.: 12/689,474

(22) Filed: Jan. 19, 2010

(65) Prior Publication Data

US 2011/0175877 A1 Jul. 21, 2011

(51) Int. Cl.
*G09G 3/30* (2006.01)

(52) U.S. Cl.
USPC ..... 345/690; 345/204

(58) Field of Classification Search
USPC ..... 345/87, 89, 98–100, 690, 204
See application file for complete search history.

(56) References Cited

U.S. PATENT DOCUMENTS 6,225,931 B1 * 5/2001 Rao et al. ..... 341/144
7,307,610 B2 * 12/2007 Sakaguchi ..... 345/89
7,375,707 B1 5/2008 Lee
8,022,971 B2 * 9/2011 Choi ..... 345/690
2007/0040855 A1 2/2007 Kato
2007/0146273 A1 * 6/2007 You ..... 345/89
2009/0096731 A1 4/2009 Woo et al.

FOREIGN PATENT DOCUMENTS

TW I301960 10/2008

OTHER PUBLICATIONS

"Office Action of Taiwan counterpart application" issued on May 16, 2013, p1-p9, in which the listed references were cited.

* cited by examiner

*Primary Examiner* — Duc Dinh
(74) *Attorney, Agent, or Firm* — J.C. Patents

(57) ABSTRACT

A gamma voltage generation circuit is provided. The gamma voltage generation circuit includes a resistor string, a first switch, and a second switch. The resistor string includes a plurality of resistors connected in series. An output terminal of the first switch is coupled to a first end of the resistor string. An output terminal of the second switch is coupled to a second end of the resistor string. The first switch selects and outputs one of a first high reference voltage and a second high reference voltage to the first end of the resistor string according to a control signal. The second switch selects and outputs one of a first low reference voltage and a second low reference voltage to the second end of the resistor string according to the control signal.

8 Claims, 4 Drawing Sheets

100

200

300

400

GAMMA VOLTAGE GENERATION CIRCUIT

BACKGROUND OF THE INVENTION

1. Field of the Invention

The present invention relates to a gamma voltage generation circuit, and more particularly, to a gamma voltage generation circuit which is capable of synchronous level shifting of gamma voltages.

2. Description of Related Art

In the current information society, information dissemination media and various electronic display apparatus are being widely used in industrial use and home use devices, which makes the electronic display apparatus more and more important. The electronic display apparatuses have been continuously developed to meet various needs in the information society.

In general, the electronic display apparatuses display and deliver a variety of pieces of information to users using the information. That is, these electronic display apparatuses convert electronic information signals into optical information signals that are visually identifiable by the users.

In existing display apparatuses or systems, such as, a cathode-ray tube (CRT) display or a liquid crystal display (LCD), its input voltage and display output are in a non-linear relationship, and the relationship between the input voltage and the display output is described by a gamma curve. As far as the LCD is concerned, input voltages (i.e., gamma voltages) for corresponding grey levels can be found using the gamma curve. Using these gamma voltages to control the LCD panel to display correct grey levels, the LCD can correctly display images.

To improve display effects of the LCD, one pixel consists of two sub-pixels in some LCD panels. The level of the common voltage for the two sub-pixels may vary due to the pixel circuitry variation. In this event of different common voltage, when the same gamma voltage is used to control the LCD panel, the two sub-pixels may display differently thus affecting the displaying quality. Therefore, the level of the outputted gamma voltages may be different to allow the different sub-pixels to display the same effect. In other words, in order for some pixels to display the same effect, a level-shifted gamma voltage must be received.

FIG. 1 is a circuit diagram of a conventional gamma voltage generation circuit. Referring to FIG. 1, the voltage between a reference voltage AGMAH and a reference voltage AGMAL is divided by resistors AR0-AR63, and gamma reference voltages AV0-AV63 are therefore outputted. The voltage between a reference voltage BGMAH and a reference voltage BGMAL is divided by resistors BR0-BR63, and gamma reference voltages BV0-BV63 are therefore outputted. Switches 110_1-110_64 select and output the gamma reference voltages AV0-AV63 as gamma voltages V0-V63 or output the gamma reference voltages BV0-BV63 as the gamma voltages V0-V63 according to a control signal S1. A digital-to-analog converter 130 selects and outputs one of the gamma voltages V63-V0 as a driving voltage.

FIG. 2 is a circuit diagram of another conventional gamma voltage generation circuit. Referring to FIG. 2, the voltage between a reference voltage GMAH and a reference voltage BGMAL is divided by resistors CR0-CR64, and gamma reference voltages CV0-CV64 are therefore outputted. The gamma reference voltage CV1 is equal to a reference voltage AGMAL and the reference voltage AGMAL is greater than the reference voltage BGMAL. Switches 210_1-210_63 selects and outputs the gamma reference voltages CV0-CV63 or CV1-CV64 as the gamma voltages V0-V63 according to a control signal S1. A digital-to-analog converter 230 selects and outputs one of the gamma voltages V63-V0 as a driving voltage.

Although capable of tuning the level of the gamma voltages V0-V63, the above-described circuit utilizes multiple switches to select the gamma reference voltages. With the increase of the number of the switches, the circuit design becomes increasingly complex and the hardware cost is increased as well.

SUMMARY OF THE INVENTION

Accordingly, the present invention is directed to a gamma voltage generation circuit which can simplify the circuit and reduce the hardware cost and which is capable of synchronous level shifting of gamma voltages.

The present invention provides a gamma voltage generation circuit including a resistor string, a first switch and a second switch. The resistor string includes a plurality of resistors connected in series. An output terminal of the first switch is coupled to a first end of the resistor string. An output terminal of the second switch is coupled to a second end of the resistor string. The first switch selects and outputs one of a first high reference voltage and a second high reference voltage to the first end of the resistor string according to a control signal, and the second switch selects and outputs one of a first low reference voltage and a second low reference voltage to the second end of the resistor string according to the control signal.

According to one embodiment of the present invention, the resistor string provides a first set of gamma voltages when the first switch outputs the first high reference voltage to the first end and the second switch outputs the first low reference voltage to the second end, and the resistor string provides a second set of gamma voltages when the first switch outputs the second high reference voltage to the first end and the second switch outputs the second low reference voltage to the second end.

According to one embodiment of the present invention, a voltage gap between the first high reference voltage and the second high reference voltage is equal to a voltage gap between the first low reference voltage and the second low reference voltage.

According to one embodiment of the present invention, the first high reference voltage is greater than the first low reference voltage, and the second high reference voltage is greater than the second low reference voltage.

The present invention also provides a gamma voltage generation circuit including a resistor string, a first switch and a second switch. The resistor string includes a plurality of resistors connected in series. An output terminal of the first switch is coupled to a first end of the resistor string. An output terminal of the second switch is coupled to a second end of the resistor string. The first switch selects and outputs one of a first high reference voltage, a second high reference voltage, and a third high reference voltage to the first end of the resistor string according to a control signal, and the second switch selects and outputs one of a first low reference voltage, a second low reference voltage, and a third low reference voltage to the second end of the resistor string according to the control signal.

According to one embodiment of the present invention, the resistor string provides a first set of gamma voltages when the first switch outputs the first high reference voltage to the first end and the second switch outputs the first low reference voltage to the second end, the resistor string provides a second set of gamma voltages when the first switch outputs the second high reference voltage to the first end and the second switch outputs the second low reference voltage to the second end, and the resistor string provides a third set of gamma voltages when the first switch outputs the third high reference voltage to the first end and the second switch outputs the third low reference voltage to the second end.

According to one embodiment of the present invention, a voltage gap between the first high reference voltage and the second high reference voltage is equal to a voltage gap between the first low reference voltage and the second low reference voltage, and a voltage gap between the second high reference voltage and the third high reference voltage is equal to a voltage gap between the second low reference voltage and the third low reference voltage.

According to one embodiment of the present invention, the first high reference voltage is greater than the first low reference voltage, the second high reference voltage is greater than the second low reference voltage, and the third high reference voltage is greater than the third low reference voltage.

According to one embodiment of the present invention, the gamma voltage generation circuit further includes a digital-to-analog converter coupled to the resistors of the resistor string. The digital-to-analog converter outputs one of gamma voltages provided by the resistors according to a data code.

In view of the foregoing, according to embodiments of the present invention, the switches of the gamma voltage generation circuit select and output the high reference voltage and low reference voltage of different voltage level according to the control signal so as to tune the level of the gamma voltages provided by the resistor string. Therefore, lesser switches may be used to achieve the level shifting of the gamma voltages thus simplifying the circuit and reducing the hardware cost. In addition, the voltage level of the gamma voltages can be tuned according to the level of the common voltage, which can make the illumination of different pixels close or even the same for the same grey level.

In order to make the aforementioned and other features and advantages of the present invention more comprehensible, embodiments accompanied with figures are described in detail below.

DESCRIPTION OF THE EMBODIMENTS

First Embodiment

Figure 3:
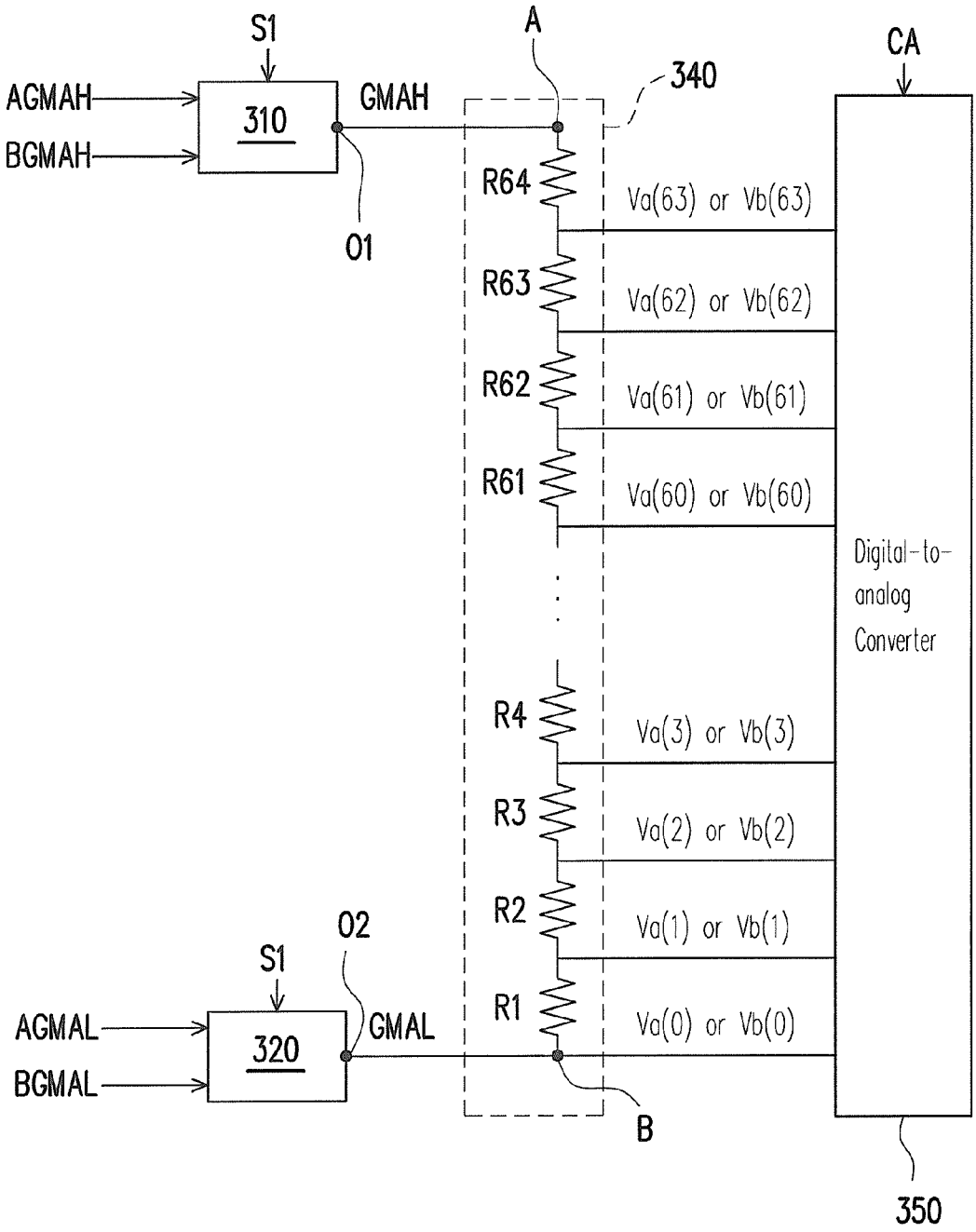
FIG. 3 is a circuit diagram of a gamma voltage generation circuit according to a first embodiment of the present invention.

FIG. 3 is a circuit diagram of a gamma voltage generation circuit according to a first embodiment of the present invention. Referring to FIG. 3, the gamma voltage generation circuit 300 includes a resistor string 340, a first switch 310, a second switch 320, and a digital-to-analog converter 350. The first switch 310 receives a first high reference voltage AGMAH and a second high reference voltage BGMAH, and an output terminal of the first switch 310 is coupled to a first end A of the resistor string 340. The first switch 310 selects and outputs one of the first high reference voltage AGMAH and the second high reference voltage BGMAH as a high reference voltage GMAH according to a control signal S1, and transmits the selected first high reference voltage AGMAH or second high reference voltage BGMAH to the first end A of the resistor string 340.

The second switch 320 receives a first low reference voltage AGMAL and a second low reference voltage BGMAL, and an output terminal of the second switch 320 is coupled to a second end B of the resistor string 340. The second switch 320 selects and outputs one of the first low reference voltage AGMAL and the second low reference voltage BGMAL as a low reference voltage GMAL according to the control signal S1, and transmits the selected low reference voltage to the second end B of the resistor string 340.

In the present embodiment, a voltage gap between the first high reference voltage AGMAH and the second high reference voltage BGMAH is equal to a voltage gap between the first low reference voltage AGMAL and the second low reference voltage BGMAL. The first high reference voltage AGMAH is greater than the first low reference voltage AGMAL. The second high reference voltage BGMAH is greater than the second low reference voltage BGMAL.

The resistor string 340 includes a plurality of resistors R1-R64 connected in series for dividing the voltage between the high reference voltage GMAH and the low reference voltage GMAL to generate a plurality of gamma voltages (e.g. Va(Va(63)-Va(0)). The resistor string 340 provides gamma voltages Va(0)-Va(63) (i.e., a first set of gamma voltages) when the first switch 310 outputs the first high reference voltage AGMAH as the high reference voltage GMAH and the second switch 320 outputs the first low reference voltage AGMAL as the low reference voltage GMAL. The resistor string 340 provides gamma voltages Vb(0)-Vb(63) (i.e., a second set of gamma voltages) when the first switch 310 outputs the second high reference voltage BGMAH as the high reference voltage GMAH and the second switch 320 outputs the second low reference voltage BGMAL as the low reference voltage GMAL.

In addition, the gamma voltages provided by the resistor string 340 vary with the level of the high reference voltage and low reference voltage. In other words, when the first high reference voltage AGMAH is greater than the second high reference voltage BGMAH and the first low reference voltage AGMAL is greater than the second low reference voltage BGMAL, the first set of gamma voltages Va(63)-Va(0) are greater than the second set of gamma voltages Vb(63)-Vb(0), respectively. That is, the gamma voltage V63*a* is greater than the gamma voltage V63*b*, the gamma voltage V62*a* is greater than the gamma voltage V62*b*, and so forth. Contrarily, when the first high reference voltage AGMAH is less than the second high reference voltage BGMAH and the first low reference voltage AGMAL is less than the second low reference voltage BGMAL, the first set of gamma voltages Va(63)-Va(0) are less than the second set of gamma voltages Vb(63)-Vb(0), respectively.

The digital-to-analog converter 350 is coupled to the resistors R1-R64 of the resistor string 340 and outputs one of gamma voltages Va(0)-Va(63) or Vb(0)-Vb(63) provided by the resistors (R1-R64) according to a data code CA. More specifically, when the first switch 310 outputs the first high reference voltage AGMAH as the high reference voltage GMAH and the second switch 320 outputs the first low reference voltage AGMAL as the low reference voltage GMAL, the digital-to-analog converter 350 outputs one of the gamma voltages Va(0)-Va(63) according to the data code CA. When the first switch 310 outputs the second high reference voltage BGMAH as the high reference voltage GMAH and the second switch 320 outputs the second low reference voltage BGMAL as the low reference voltage GMAL, the digital-to-analog converter 350 outputs one of the gamma voltages Vb(63)-Vb(0) according to the data code CA.

Figure 1:
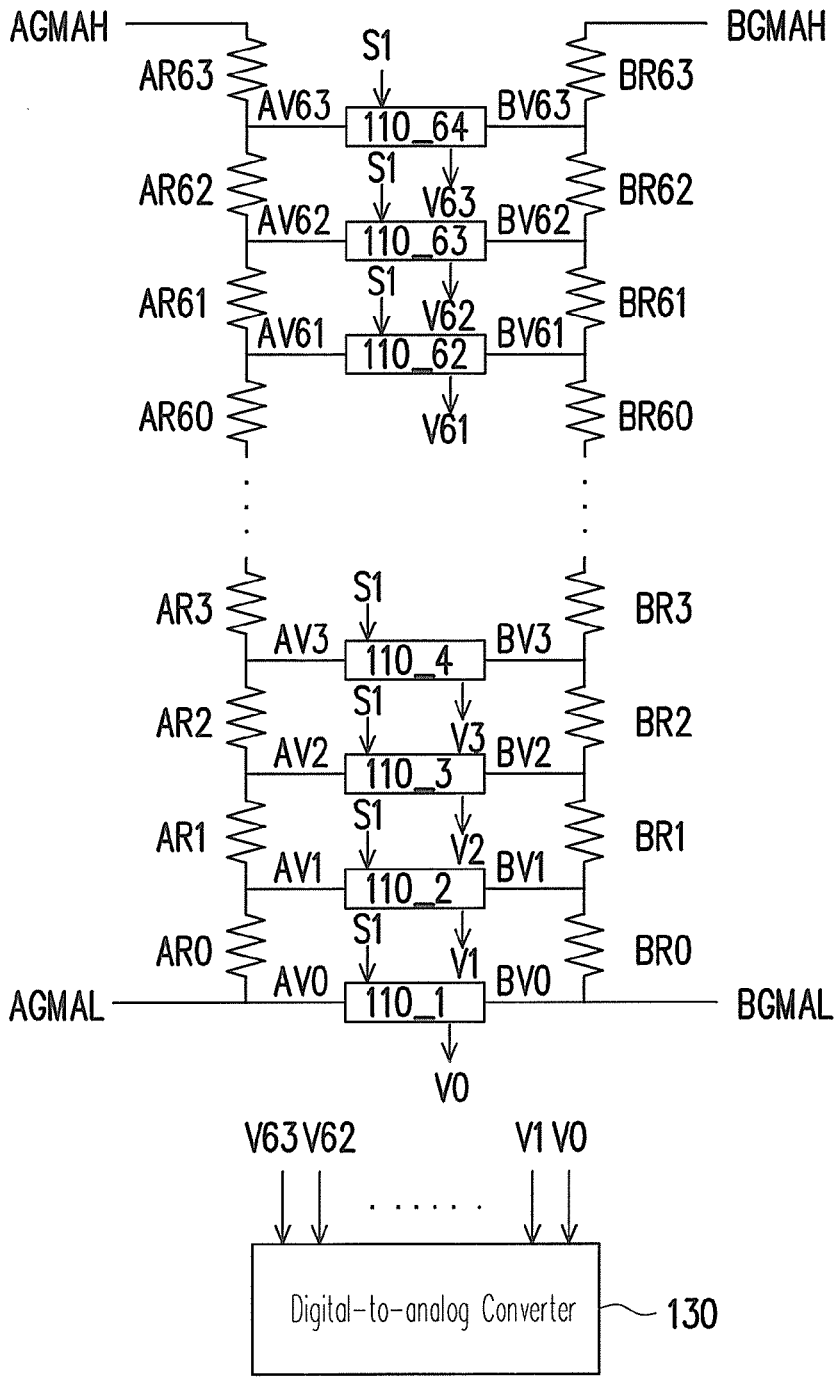
FIG. 1 (RELATED ART)
FIG. 1 is a circuit diagram of a conventional gamma voltage generation circuit.
Figure 2:
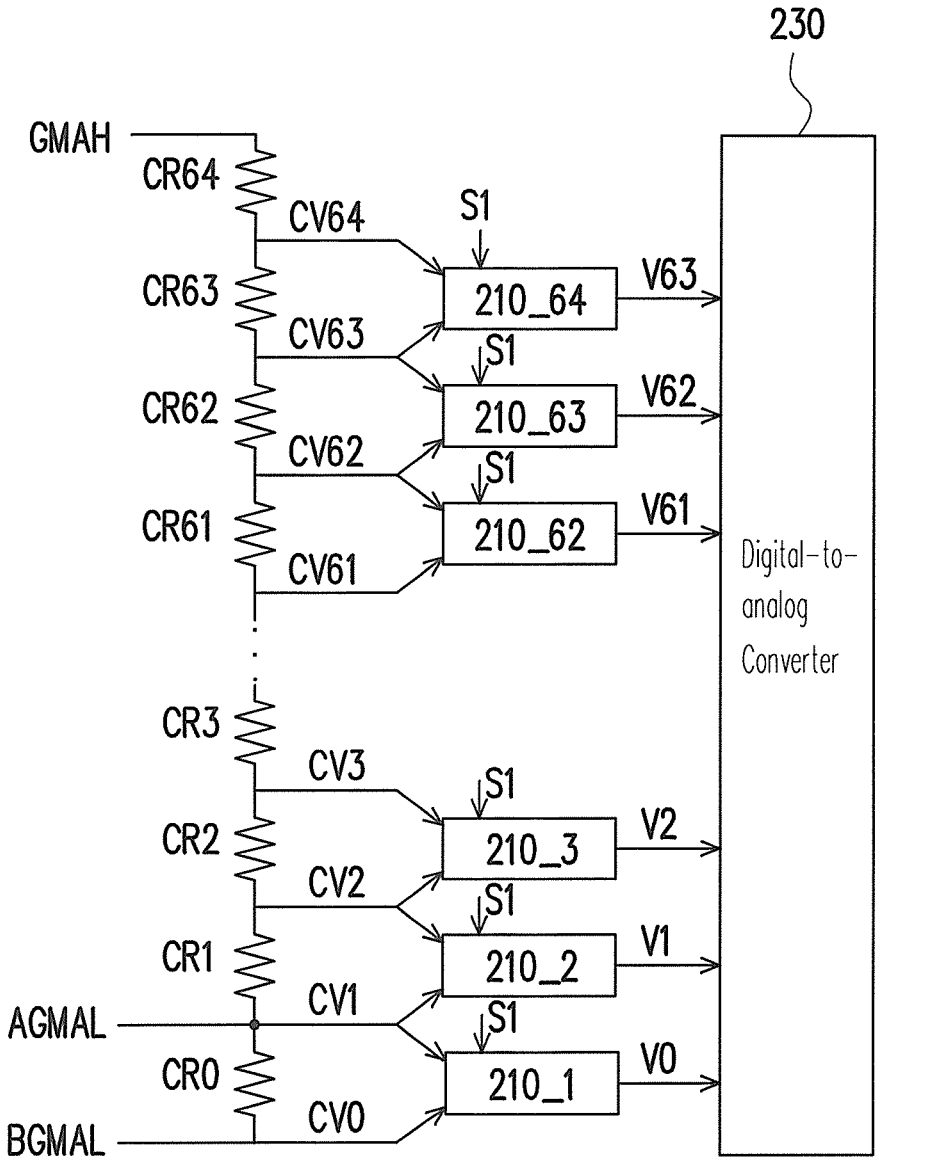
FIG. 2 (RELATED ART)
FIG. 2 is a circuit diagram of another conventional gamma voltage generation circuit.

The gamma voltage outputted by the digital-to-analog converter 350 is used as a driving voltage for driving the liquid crystal pixel to illuminate at a corresponding grey level. Therefore, lesser switches may be used to achieve the level shifting of the gamma voltages thus simplifying the circuit and reducing the hardware cost. The gamma voltage generation circuit 300 provides two gamma curves, one of which provides the gamma voltages Va(0)-Va(63), and the other one provides the gamma voltages Vb(0)-Vb(63). In addition, when the level of the common voltages of different pixels (or sub-pixel) is different, the reference voltages of different levels can be outputted to tune the level of respective gamma voltages according to the control signal S1 so as to make the illumination of different pixels close or even the same for the same grey level. For example, in an LCD panel that one pixel thereof has two sub-pixels applied by different common voltages, when driving the two sub-pixels of the same pixel, one of the sub-pixels may be driven by the gamma voltages Va(0)-Va(63), and the other sub-pixel may be driven by the gamma voltages Vb(0)-Vb(63), such that the phenomenon of color shift of the LCD panel would be avoided. It should be noted that FIG. 1 illustrates a 6-bit gamma voltage generator (i.e., the number of the resistors in the resistor string is the sixth power of two) and, if an 8-bit gamma voltage generator is desired, the number of the resistors of the resistor string and the switches can be increased to 256 (i.e., the eighth power of two), and the gamma voltage generator of the other bit (e.g. 10-bit) can be achieved in the same manner.

Second Embodiment

Figure 4:
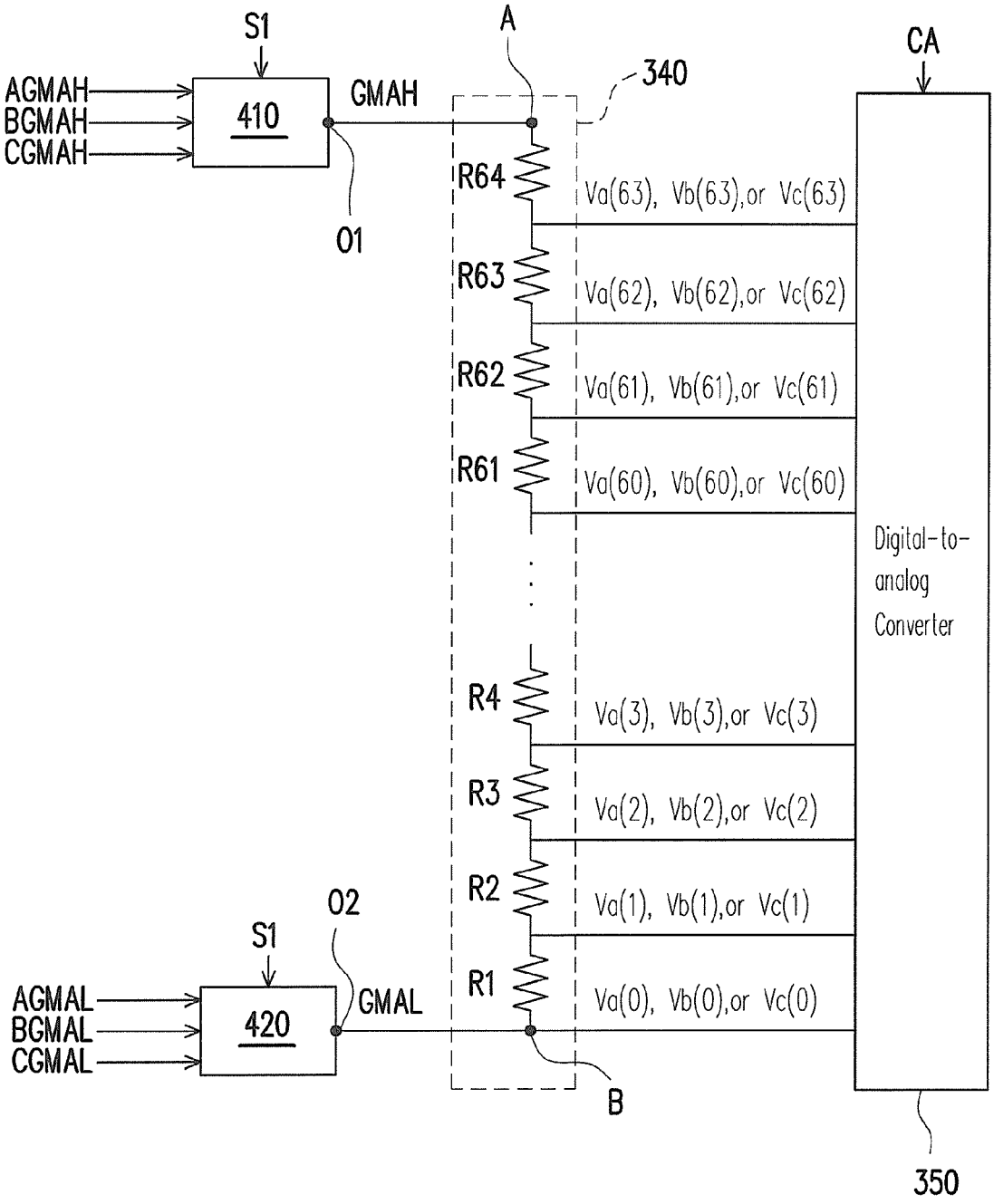
FIG. 4 is a circuit diagram of a gamma voltage generation circuit according to a second embodiment of the present invention.

FIG. 4 is a circuit diagram of a gamma voltage generation circuit according to a second embodiment of the present invention. Referring to FIGS. 3 and 4, the difference lies in the switches 410 and 420 of the gamma voltage generation circuit 400. The first switch 410 receives a first high reference voltage AGMAH, a second high reference voltage BGMAH, and a third high reference voltage CGMAH. The first switch 410 selects and outputs one of the first high reference voltage AGMAH, the second high reference voltage BGMAH, and the third high reference voltage CGMAH as a high reference voltage GMAH.

The second switch 420 receives a first low reference voltage AGMAL, a second low reference voltage BGMAL, and a third low reference voltage CGMAL. The second switch 420 selects and outputs one of the first low reference voltage AGMAL, the second low reference voltage BGMAL, and the third low reference voltage CGMAL as a low reference voltage GMAL. In the present embodiment, a voltage gap between the second high reference voltage BGMAH and the third high reference voltage CGMAH is equal to a voltage gap between the second low reference voltage BGMAL and the third low reference voltage CGMAL, and the third high reference voltage CGMAH is greater than the third low reference voltage CGMAL.

The resistor string 340 provides gamma voltages Va(0)-Va(63) (i.e., a first set of gamma voltages) when the first switch 410 outputs the first high reference voltage AGMAH as the high reference voltage GMAH and the second switch 420 outputs the first low reference voltage AGMAL as the low reference voltage. The resistor string 340 provides gamma voltages Vb(0)-Vb(63) (i.e., a second set of gamma voltages) when the first switch 410 outputs the second high reference voltage BGMAH as the high reference voltage and the second switch 420 outputs the second low reference voltage BGMAL as the low reference voltage. The resistor string 340 provides gamma voltages Vc(0)-Vc(63) (i.e., a third set of gamma voltages) when the first switch 410 outputs the third high reference voltage CGMAH as the high reference voltage and the second switch 420 outputs the third low reference voltage CGMAL as the low reference voltage.

When the first high reference voltage AGMAH>the second high reference voltage BGMAH>the third high reference voltage CGMAH, and the first low reference voltage AGMAL>the second low reference voltage BGMAL>the third low reference voltage CGMAL, the first set of gamma voltages>the second set of gamma voltages>the third set of gamma voltages. The relationship among the gamma reference voltages of the various sets of gamma voltages can be represented by the following inequality:

$$Va(n)>Vb(n)>Vc(n)$$

where, n is an integer satisfying the relationship $63 \geq n \geq 0$.

In addition, when the relationship among the high reference voltages AGMAH, BGMAH and CGMAH and the low reference voltages AGMAL, BGMAL and CGMAL is different from the relationship described above, the relationship among the first set of gamma voltages, the second gamma voltages and the third set of gamma voltages is different from the relationship described above accordingly, which can then be determined by analogy based on the high reference voltage and low reference voltage corresponding to the respective set of gamma voltages.

When the first switch 410 outputs the first high reference voltage AGMAH as the high reference voltage GMAH and the second switch 420 outputs the first low reference voltage AGMAL as the low reference voltage GMAL, the digital-to-analog converter 350 outputs one of the gamma voltages Va(63)-Va(0) according to the data code CA. When the first switch 410 outputs the second high reference voltage BGMAH as the high reference voltage GMAH and the second switch 420 outputs the second low reference voltage BGMAL as the low reference voltage GMAL, the digital-to-analog converter 350 outputs one of the gamma voltages Vb(63)-Vb(0) according to the data code CA. Besides, when the first switch 410 outputs the third high reference voltage CGMAH as the high reference voltage GMAH and the second switch outputs the third low reference voltage CGMAL as the low reference voltage GMAL, the digital-to-analog converter 350 outputs one of the gamma voltages Vc(63)-Vc(0) as the driving voltage. Therefore, the gamma voltage generation circuit 400 provides three gamma curves. The first one of the three gamma curves provides the gamma voltages Va(0)-Va(63), the second one of the three gamma curves provides the gamma voltages Vb(0)-Vb(63), and the third one of the three gamma curves provides the gamma voltage Vc(0)-Vc(63). The phenomenon of color shift of the LCD panel would be avoided by applying proper gamma voltages to the subpixels of the LCD panel. For example, in an LCD panel that one pixel thereof has two sub-pixels applied by different common voltages, when driving the two sub-pixels of the same pixel, one of the sub-pixels may be driven by using one of the three gamma curves, and the other sub-pixel may be driven by using another one of the three gamma curves, such that the phenomenon of color shift of the LCD panel would be avoided.

It is noted that, in alternative embodiments, the first switch and the second switch may also receive a plurality of high reference voltages and a plurality of low reference voltages and output one of the high reference voltages and a corresponding one of the low reference voltages according to a control signal S1, respectively, to allow the resistor string to generate a plurality of gamma voltages. Therefore, lesser switches may be used to achieve the level shifting of the gamma voltages, which can make the illumination of different pixels close or even the same for the same grey level.

In summary, according to embodiments of the present invention, the switches of the gamma voltage generation circuit select and output the high reference voltage and low reference voltage of different voltage level according to the control signal so as to tune the level of the gamma voltages provided by the resistor string. Therefore, lesser switches may be used to achieve the level shifting of the gamma voltages thus simplifying the circuit and reducing the hardware cost. In addition, the voltage level of the gamma voltages can be tuned according to the level of the common voltage, which can make the illumination of different pixels close or even the same for the same grey level.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gamma voltage generation circuit, comprising:

a resistor string, comprising a plurality of resistors connected in series;

a first switch, an output terminal of the first switch being coupled to a first end of the resistor string; and a second switch, an output terminal of the second switch being coupled to a second end of the resistor string;

wherein the first switch selects and outputs one of a first high reference voltage and a second high reference voltage to the first end of the resistor string according to a control signal, and the second switch selects and outputs one of a first low reference voltage and a second low reference voltage to the second end of the resistor string according to the control signal, the resistor string provides a first set of gamma voltages when the first switch outputs the first high reference voltage to the first end and the second switch outputs the first low reference voltage to the second end, and the resistor string provides a second set of gamma voltages when the first switch outputs the second high reference voltage to the first end and the second switch outputs the second low reference voltage to the second end.

2. The gamma voltage generation circuit as claimed in claim 1, wherein a voltage gap between the first high reference voltage and the second high reference voltage is equal to a voltage gap between the first low reference voltage and the second low reference voltage.

3. The gamma voltage generation circuit as claimed in claim 1, further comprising a digital-to-analog converter, coupled to the resistors of the resistor string, wherein the digital-to-analog converter outputs one of gamma voltages provided by the resistors according to a data code.

4. The gamma voltage generation circuit as claimed in claim 1, wherein the first high reference voltage is greater than the first low reference voltage, and the second high reference voltage is greater than the second low reference voltage.

5. A gamma voltage generation circuit, comprising:

a resistor string, comprising a plurality of resistors connected in series;

a first switch, an output terminal of the first switch being coupled to a first end of the resistor string; and a second switch, an output terminal of the second switch being coupled to a second end of the resistor string;

wherein the first switch selects and outputs one of a first high reference voltage, a second high reference voltage, and a third high reference voltage to the first end of the resistor string according to a control signal, and the second switch selects and outputs one of a first low reference voltage, a second low reference voltage, and a third low reference voltage to the second end of the resistor string according to the control signal, the resistor string provides a first set of gamma voltages when the first switch outputs the first high reference voltage to the first end and the second switch outputs the first low reference voltage to the second end, the resistor string provides a second set of gamma voltages when the first switch outputs the second high reference voltage to the first end and the second switch outputs the second low reference voltage to the second end, and the resistor string provides a third set of gamma voltages when the first switch outputs the third high reference voltage to the first end and the second switch outputs the third low reference voltage to the second end.

6. The gamma voltage generation circuit as claimed in claim 5, wherein a voltage gap between the first high reference voltage and the second high reference voltage is equal to a voltage gap between the first low reference voltage and the second low reference voltage, and a voltage gap between the second high reference voltage and the third high reference voltage is equal to a voltage gap between the second low reference voltage and the third low reference voltage.

7. The gamma voltage generation circuit as claimed in claim 5, further comprising a digital-to-analog converter, coupled to the resistors of the resistor string, wherein the digital-to-analog converter outputs one of gamma voltages provided by the resistors according to a data code.

8. The gamma voltage generation circuit as claimed in claim 5, wherein the first high reference voltage is greater than the first low reference voltage, the second high reference voltage is greater than the second low reference voltage, and the third high reference voltage is greater than the third low reference voltage.

* * * * *